US007415973B2

(12) United States Patent
Yoshizumi et al.

(10) Patent No.: US 7,415,973 B2
(45) Date of Patent: Aug. 26, 2008

(54) FUEL INJECTION PUMP EQUIPPED WITH ROTARY DEFLECTOR

(75) Inventors: Hiroshi Yoshizumi, Kanagawa-ken (JP); Yasumichi Aoki, Kanagawa-ken (JP); Shouji Namekawa, Kanagawa-ken (JP); Minoru Esaki, Kanagawa-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/822,968

(22) Filed: Jul. 11, 2007

(65) Prior Publication Data

US 2008/0105234 A1 May 8, 2008

(30) Foreign Application Priority Data

Nov. 6, 2006 (JP) ..... 2006-300563

(51) Int. Cl.
*F02M 37/04* (2006.01)
*F02M 37/06* (2006.01)

(52) U.S. Cl. ..... 123/495; 123/506

(58) Field of Classification Search ..... 123/450, 123/457, 459, 446, 506, 495; 417/569, 490, 417/494, 499, 273
See application file for complete search history.

(56) References Cited

U.S. PATENT DOCUMENTS 3,477,386 A * 11/1969 Staudt ..... 417/490
4,690,624 A * 9/1987 Schwartz ..... 417/499
5,015,160 A * 5/1991 Hlousek et al. ..... 417/499
5,226,794 A * 7/1993 Ziehl et al. ..... 417/499

FOREIGN PATENT DOCUMENTS

| | | |
|---|---|---|
| BE | 831 834 | 11/1975 |
| DE | 0 347 581 | 5/1989 |
| DE | 0 877 163 | 11/1998 |
| EP | 214115 A1 * | 3/1987 |
| JP | 9-144627 | 6/1997 |
| JP | 10-266927 | 10/1998 |
| JP | 2000-179428 | 6/2000 |
| JP | 3585784 | 8/2004 |

OTHER PUBLICATIONS

U.S. Pat. No. 5,015,160 to Hlousek et al. corresponding to DE 0 347 581 (May 18, 1989).
European Search Report mailed May 2008 in corresponding application EP 1 921 305.

* cited by examiner

*Primary Examiner*—Mahmoud Gimie
(74) *Attorney, Agent, or Firm*—Wenderoth, Lind & Ponack, L.L.P.

(57) ABSTRACT

A fuel injection pump equipped with a rotary deflector having an increased lifetime and reduced maintenance cost required to replace the deflector when it is wasted due to cavitation erosion. The deflector comprises a stationary holder and a tip member which is supported rotatably by the stationary holder so that the tip member is rotated by fuel flow that outbursts from the plunger room through the inlet/spill port and impinges against the tip member when fuel injection ends. This evades concentrated impingement at a specific portion of the tip member and prevents the occurrence of cavitation erosion.

7 Claims, 5 Drawing Sheets

FUEL INJECTION PUMP EQUIPPED WITH ROTARY DEFLECTOR

BACKGROUND OF THE INVENTION

1. Field of the Invention

The present invention relates to a fuel injection pump for diesel engines. Specifically, the present invention relates to a fuel injection pump equipped with deflectors at input/spill ports of a plunger barrel in order to prevent occurrence of cavitations when fuel is spilled through the ports to finish fuel injection by allowing high-pressure fuel spilled from the plunger room through the ports to impinge against the deflectors.

2. Description of the Related Art

In many of jerk fuel injection pumps for diesel engines, deflectors are provided at input/spill ports of the plunger barrel so that fuel spilled from the plunger room at high speed through the ports impinges against the deflectors in order to prevent impingement of the high speed fuel against the casing of the injection pump, since the impingement induces cavitation erosion on the inside surface of the ports and fuel gallery surrounding the ports.

FIG. 5 is a sectional view along the center line of a plunger of a jerk fuel injection pump for a diesel engine to which the present invention is applied.

In FIG. 5, a plunger barrel 102 is fixedly provided in a pump case 105. A plunger 100 is fit in the plunger barrel 102 to be reciprocated. The plunger 100 is driven to reciprocate by means of a fuel cam not shown in the drawing via a tappet 106 and tappet spring 107. A plunger room 111 is formed in the plunger barrel 102 above the top face of the plunger 100. Fuel fed from a fuel gallery 104 formed between the inner surface of the pump case 105 and outer surface of the plunger barrel 102 through the input/spill ports 103 into the plunger room 111 is compressed to a high pressure by moving the plunger 100 in an upward direction. The highly pressurized fuel pushes open a delivery valve 108 seating on a valve seat 110, and the highly pressurized fuel flows through an outlet passage 109 to a fuel injection valve not shown in the drawing.

Deflectors 10 are located at the fuel gallery side openings of the inlet/spill ports 103. When the spill groove 101 of the plunger 100 uncovers the inlet/spill ports 103, pressurized fuel in the plunger room outbursts through the ports 103 and impinges against the deflectors 10. Occurrence of cavitation erosion on the surface of the inlet/spill ports 103 and the fuel gallery 104 is prevented by the impingement of fuel against the deflectors 10.

Fuel injection pumps equipped with deflectors like this are disclosed in Japanese Laid-Open Patent Application No. 2000-179428 (patent literature 1) and Japanese Laid-Open Patent Application No. 9-144627 (patent literature 2).

In the fuel injection pump disclosed in the patent literature 1, the deflector for preventing cavitation erosion is shaped into a hexagonal socket head bolt having a protrusion to be inserted into the inlet/spill port with a plurality of fuel passages drilled to surround the socket part of the bolt to allow fuel that outbursts from the plunger room through the inlet/spill port to flow into the fuel gallery, wherein the deflector is screwed to the plunger barrel and further retained to the plunger barrel by means of a snap ring in order to prevent it from slipping out even when the screw has loosened.

In the fuel injection pump disclosed in the patent literature 2, the deflector is screwed to the pump case to face the inlet/spill port. Porous material is adhered on the end of the deflector facing the port to allow fuel bursting out through the port to impinge against the porous material, thereby alleviating rapid pressure change at the fuel impinging part and preventing occurrence of cavitation erosion.

In these prior art, the deflector is fixed securely to the plunger or pump case.

BRIEF SUMMARY OF THE INVENTION

The object of the present invention is to provide an improved deflector for preventing occurrence of cavitation erosion and elongating lifetime of the deflector. The invention proposes a fuel injection pump equipped with a rotary deflector, with which lifetime of the deflector is increased and maintenance cost, which is required to replace the deflector when it is wasted due to cavitation erosion, is decreased.

To attain the object, the present invention proposes a fuel injection pump equipped with rotary deflectors against which spilled fuel that outbursts from a plunger room through inlet/spill ports drilled in a plunger barrel and flows into a fuel gallery when fuel injection ends is allowed to impinge. Each of the rotary deflectors comprises a stationary holder and a rotatable tip member. Further, the stationary holder is fixed to the plunger barrel or a pump case accommodating the plunger barrel. In addition, the rotatable tip member is supported rotatably by the stationary holder. Further, the rotatable tip member has (i) a spilled fuel inlet hole that is drilled in the center of the tip member to open in the inlet/spill ports and (ii) a spilled fuel outlet hole or holes that are drilled radially to open into the fuel gallery and to communicate to the spilled fuel inlet hole.

In the invention, it is preferable that a plurality of the spilled fuel outlet holes are drilled radially in a shape like the spokes of a wheel, and further it is preferable that a plurality of the spilled fuel outlet holes are drilled tangentially to rotation direction of the tip member.

According to the invention, the deflector against which fuel that outbursts through the inlet/spill ports is allowed to impinge is divided into the stationary holder and the rotatable tip member supported rotatably by the stationary holder. The tip member having the spilled fuel inlet hole and spilled fuel outlet hole or holes for allowing the fuel passed through the spilled fuel inlet hole to be flowed out into the fuel gallery, so that the tip member against which fuel that outbursts through the inlet/spill ports is allowed to impinge is rotated by force that the spilled fuel exerts on the tip member. This results in that an impingement of the spilled fuel outbursting through the inlet/spill ports on the tip member at a specific part thereof, as has been the case in conventional deflectors, can be evaded.

Therefore, (i) occurrence of cavitation erosion at the end of the tip member of the deflector caused by repetition of impingement of the high-pressure spilled fuel outbursting from the plunger room through the inlet/spill ports on the end of the tip member is prevented, (ii) lifetime of the deflector is elongated, and (iii) maintenance cost for replacing the deflector is decreased.

Further, by providing a plurality of the spilled fuel outlet holes such that they are drilled tangentially to a rotation direction of the tip member, reaction force is generated by fuel flowing out through the tangential holes to rotate the tip member, so the tip member is positively rotated periodically every time fuel outbursts through the inlet/spill port, and impingement of fuel on the tip member at a specific part of the tip member can be evaded more positively, that is, parts hit by the outbursting fuel are dispersed more positively.

In the invention, it is preferable that the tip member has a flange part to be supported axially by a stationary holder with small side clearances provided between the stationary holder, and radial balance oil passages communicating to the spilled fuel inlet hole and axial balance holes communicating to the radial balance oil passages are drilled in the flange part.

With this construction, a part of spilled fuel introduced into the spilled fuel inlet hole introduced to the side clearances of the flange part of the tip member to lubricate therein, so the tip member can be rotated smoothly without occurrence of sticking or seizure of the flange part of the rotatable tip member, resulting in elongated lifetime of the deflector.

The deflector of the invention can be applied to a so-called solid type deflector. For this type of deflector, the invention proposes a fuel injection pump equipped with rotary deflectors against which spilled fuel that outbursts from a plunger room through inlet/spill ports drilled in a plunger barrel and flows into a fuel gallery when fuel injection ends is allowed to impinge. Each of the rotary deflectors comprises a stationary holder and a rotatable tip member. The stationary holder being fixed to the plunger barrel or a pump case accommodating the plunger barrel. The rotatable tip member is supported rotatably by the stationary holder. Further, the rotatable tip member has (i) a solid part against which fuel that outbursts from the plunger room impinges, (ii) a spilled fuel inlet hole or holes drilled from the outer periphery of the solid part of the tip member intruding into the inlet/spill port toward the center of the solid part of the tip member to communicate to a succeeding center hole, and (iii) a spilled fuel outlet hole or holes that are drilled radially to open into the fuel gallery and to communicate to the center hole in the solid part.

In the invention, it is preferable that a plurality of the spilled fuel outlet holes are drilled radially in a shape like the spokes of a wheel, and further it is preferable that a plurality of the spilled fuel outlet holes are drilled tangentially to rotation direction of the tip member.

According to the invention, fuel that outbursts through the inlet/spill port impinges on the apical portion of the solid part of the rotatable tip member and enters the spilled fuel inlet hole or holes. As a result, the tip member can be rotated by the spilled fuel flow. Therefore, portions where the spilled fuel impinges upon are dispersed and repeated fuel impingement on a specific portion can be evaded.

Further, by providing a plurality of the spilled fuel outlet holes such that they are drilled tangentially to rotation direction of the tip member, reaction force is generated by fuel flowing out through the tangential holes to rotate the tip member, so the tip member is positively rotated periodically every time fuel outbursts through the inlet/spill port, and impingement of fuel against the tip member at a specific part of the tip member can be evaded more positively, that is, parts hit by the outbursting fuel are dispersed more positively.

DETAILED DESCRIPTION OF THE INVENTION

Preferred embodiments of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

The First Embodiment

Figure 5:
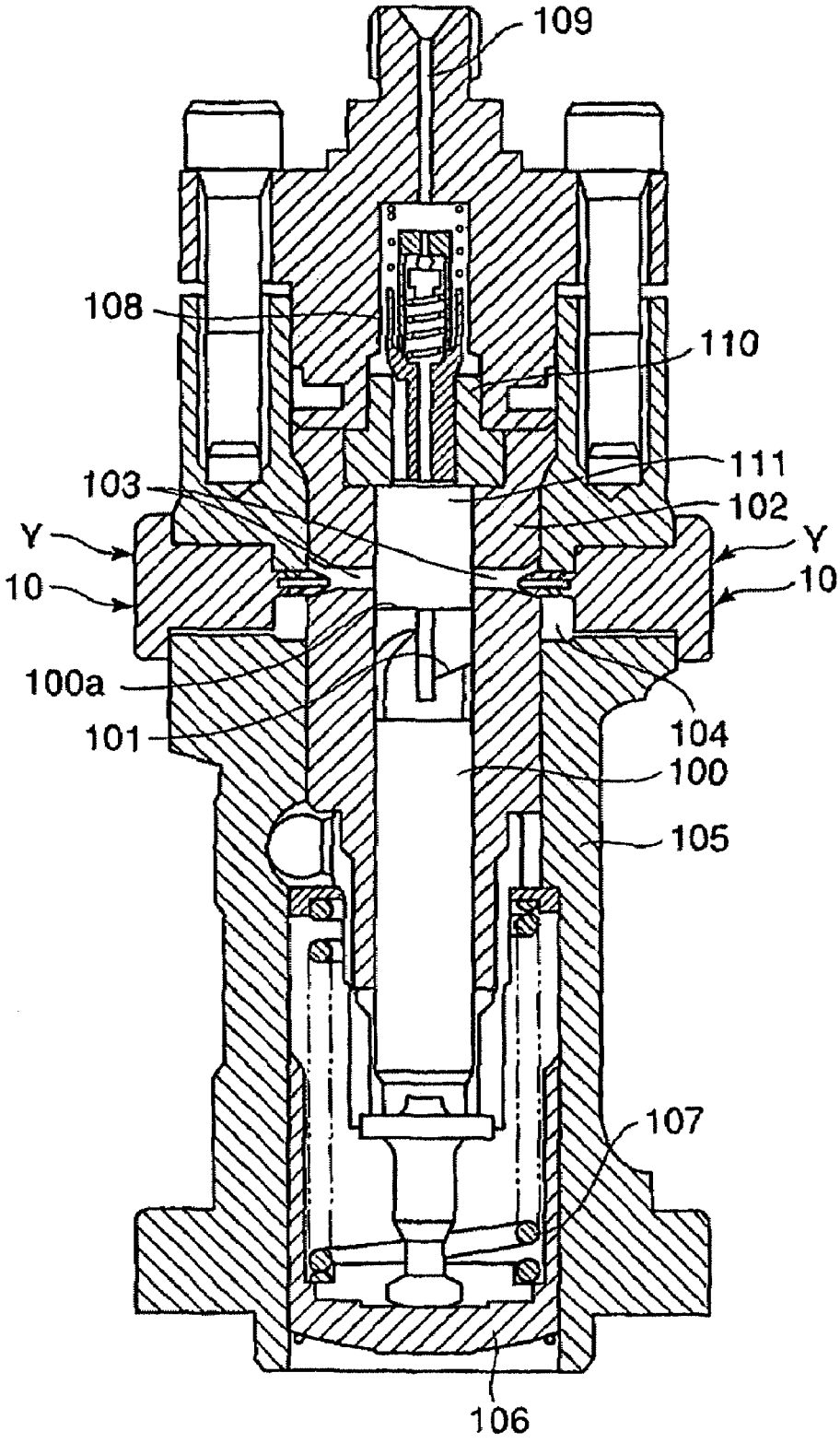
FIG. 5 is a sectional view along the center line of the plunger of a jerk fuel injection pump for a diesel engine to which the present invention is applied.
Figure 6:
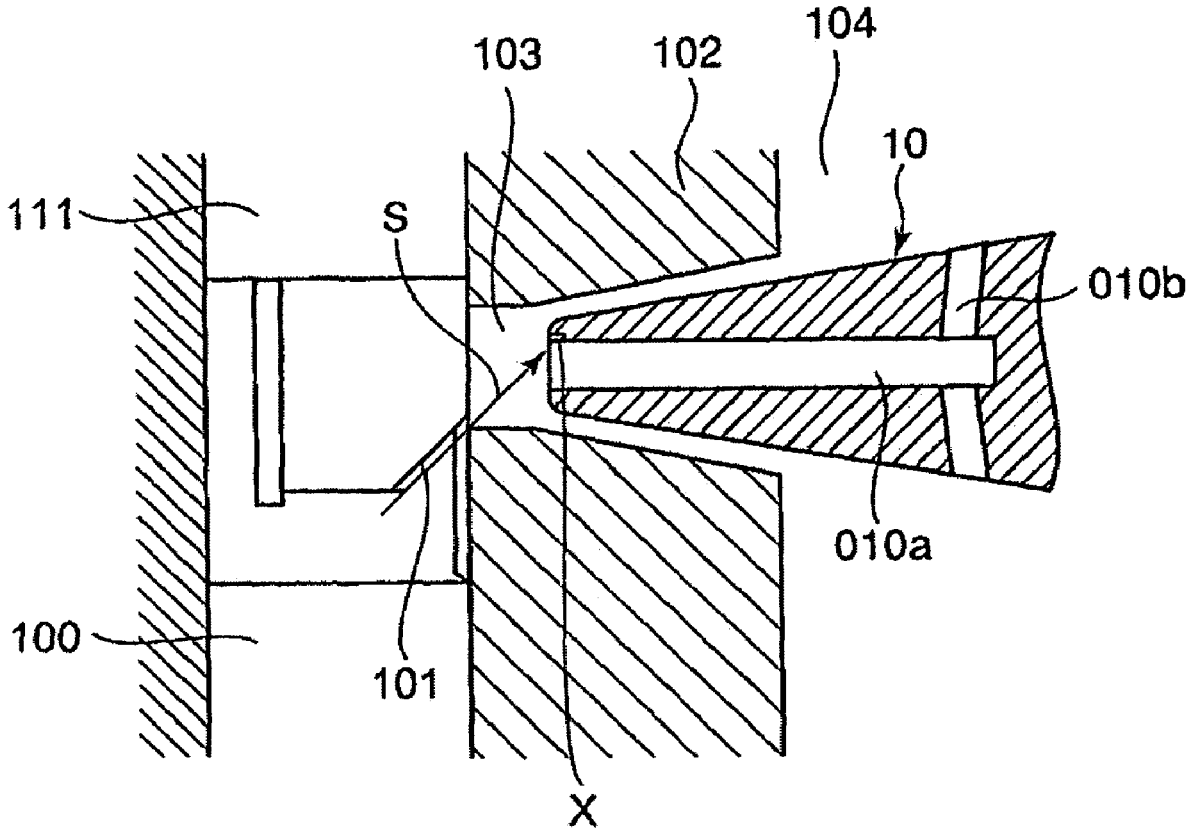
FIG. 6 is a drawing for explaining impingement of fuel jet flow against the deflector.

FIG. 1A is a sectional view of the deflector in a jerk fuel injection pump of a first embodiment for a diesel engine (corresponding to part Y in FIG. 5), and FIG. 1B is an enlarged detail of part Z in FIG. 1A.

Figure 1:
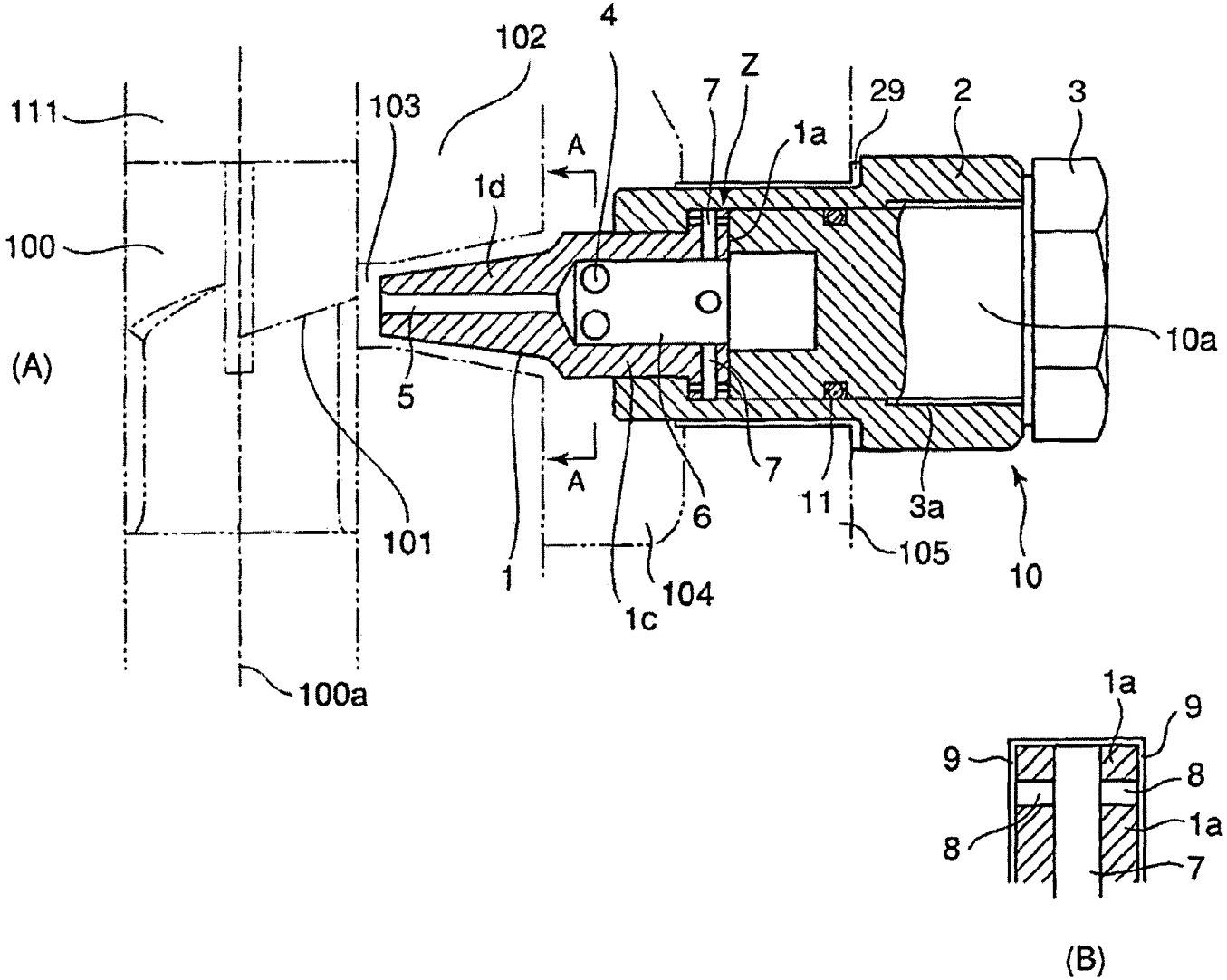
FIG. 1A is a sectional view of the deflector in a jerk fuel injection pump of a first embodiment for a diesel engine (corresponding to part Y in FIG. 5)
FIG. 1B is an enlarged detail of part Z in FIG. 1A.

Referring to FIG. 1, a plunger barrel 102 is fixedly provided in a pump case 105. A plunger 100 is fit in the plunger barrel 102 to be reciprocated. The plunger 100 is driven to reciprocate by means of a fuel cam not shown in the drawing via a tappet 106 and tappet spring 107.

A plunger room 111 is formed in the plunger barrel 102 above the top face of the plunger 100. Fuel fed from a fuel gallery 104 formed between the inner surface of the pump case 105 and outer surface of the plunger barrel 102 through the input/spill ports into the plunger room 111 is compressed to a high pressure by moving up of the plunger 100 and supplied to an injection valve not shown in the drawing.

When a spill groove 101 of the plunger 100 uncovers the inlet/spill ports 103, pressurized fuel in the plunger room 111 flows through the ports 103 into the fuel gallery 104.

A deflector 10 is located at each of the inlet/spill port 103 so that highly pressurized fuel that outbursts through the inlet/spill port 103 when the spill groove 101 of the plunger 100 uncovers the port 103 while moving up impinges against the deflector 10. Occurrence of cavitation erosion on the surface of the inlet/spill ports 103 and the fuel gallery 104 is prevented by the impingement of fuel against the deflectors 10.

The deflector 10 comprises a stationary holder comprising case member 2 screwed to the pump case 105 and a bolt member 3 screwed into the case member 2, and a tip member 1 held rotatably by the case member 2.

The tip member 1 has a tapered tip part 1*d*, a cylindrical part 1*c*, and a flange part 1*a*. The cylindrical part 1*c* and flange part 1*a* of the tip member 1 is received in the case member 2 so that the tip member 1 is rotatable relative to the case member.

The case member 2 is screwed into the pump case 105 via a gasket 29. The bolt member 3 is screwed into the case member 2 so that the end face thereof supports axially the end face of the flange part 1*a* of the tip member 1. Reference numeral 11 is an 'O' ring for sealing the outer circumference of the bolt member 3 and inner circumference of the case member 2.

The deflector 10 is fixed to the pump case such that the tapered tip part 1*d* of the tip member 1 intrudes into the port 103.

The flange part 1*a* of the tip member 1 is held between the end face of the bolt member 3 and the shoulder face inside the case member 2 with small gaps 9, 9 retained in axial direction of the deflector 10, and radial balance oil passages 7, 7 and axial balance oil passage 8, 8 are provided to the flange part 1*a* to introduce a part of fuel entered a central hollow 6 through a spilled fuel inlet opening 5 mentioned later of the tip member 1 to the gaps 9, 9, as shown in FIG. 1B so that the small gaps 9, 9 are always filled with fuel.

With the construction, a part of fuel spilled fuel is introduced into the small gaps 9, 9, the tip member 1 can rotate in the case member smoothly in a state sufficiently lubricated by fuel oil, so occurrence of sticking or seizure of the tip member 1 is prevented, resulting in elongated lifetime of the deflector 10.

The tip member 1 has a spilled fuel inlet opening 5 and a central hollow 6 communicating to the inlet opening 5, and a plurality of spilled fuel outlet holes 4 (four holes in this example) are drilled radially in the cylindrical part 1*c* of the tip member 1 to open toward the fuel gallery 104.

Figure 3:
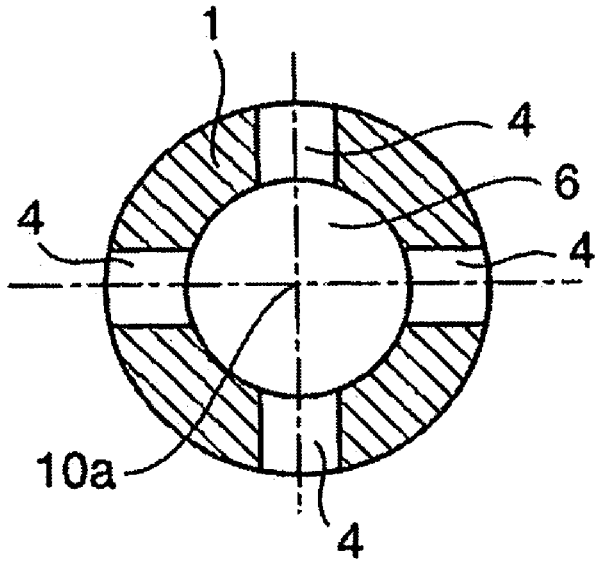
FIG. 3 is a section along line A-A in FIG. 1A and shows a first example of spilled fuel outlet holes in the deflector of the first embodiment.

FIG. 3 is a first example of the spilled fuel outlet holes 4 shown in a section along line A-A in FIG. 1A. In the example, four spilled fuel outlet holes 4 are drilled radially with the center axes thereof passing the center 10*a* of the central hollow 6 of the tip member 1.

Figure 2:
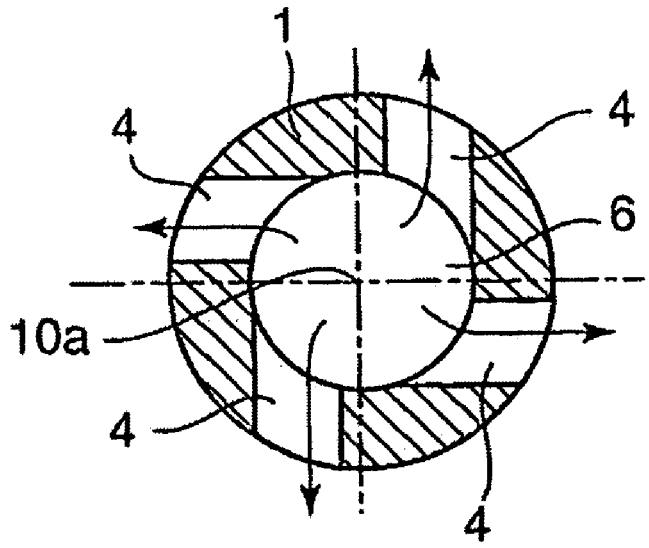
FIG. 2 is a section along line A-A in FIG. 1A and shows a second example of spilled fuel outlet holes in the deflector of the first embodiment.

FIG. 2 is a second example of the spilled fuel outlet holes 4 shown in a section along line A-A in FIG. 1A. In the example, four spilled fuel outlet holes 4 are drilled tangential to the circumference of the central hollow 6 of the tip member 1. In this case, reaction force is generated by fuel flowing out through the spilled outlet holes 4 to rotate the tip member 1, the tip member 1 is positively rotated periodically every time fuel outbursts through the inlet/spill ports, so impingement of fuel against the tip member at a specific part of the tip member can be evaded more positively, that is, parts hit by the outbursting fuel are dispersed more positively.

In FIGS. 1 to 3, reference numeral 10*a* is the center of the deflector 10.

According to the first embodiment, the deflector 10 against which fuel that outbursts through the inlet/spill ports 103 is allowed to impinge is divided into a stationary holder including the case member 2 and bolt member 3 and the rotatable tip member 1 supported rotatably by the stationary holder, the tip member having the spilled fuel inlet hole 5 and the plurality of spilled fuel outlet holes 4 for allowing the fuel passed through the spilled fuel inlet hole 5 to be flowed out into the fuel gallery 104, so the tip member 1 against which fuel that outbursts through the inlet/spill ports 103 is allowed to impinge is rotated by force that the spilled fuel exerts on the tip member 1.

This results in the impingement of the spilled fuel outbursting through the inlet/spill ports 103 against the tip member 1 at a specific part thereof, as has been the case in conventional deflectors, being evaded.

Therefore, (i) occurrence of cavitation erosion at the end of the tip member 1 of the deflector 10 caused by repetition of impingement of the high-pressure spilled fuel outbursting through the inlet/spill ports 103 on the end of the tip member 1 is prevented, (ii) lifetime of the deflector 10 is elongated, and (iii) maintenance cost for replacing the deflector 10 is decreased.

The Second Embodiment

Figure 4:
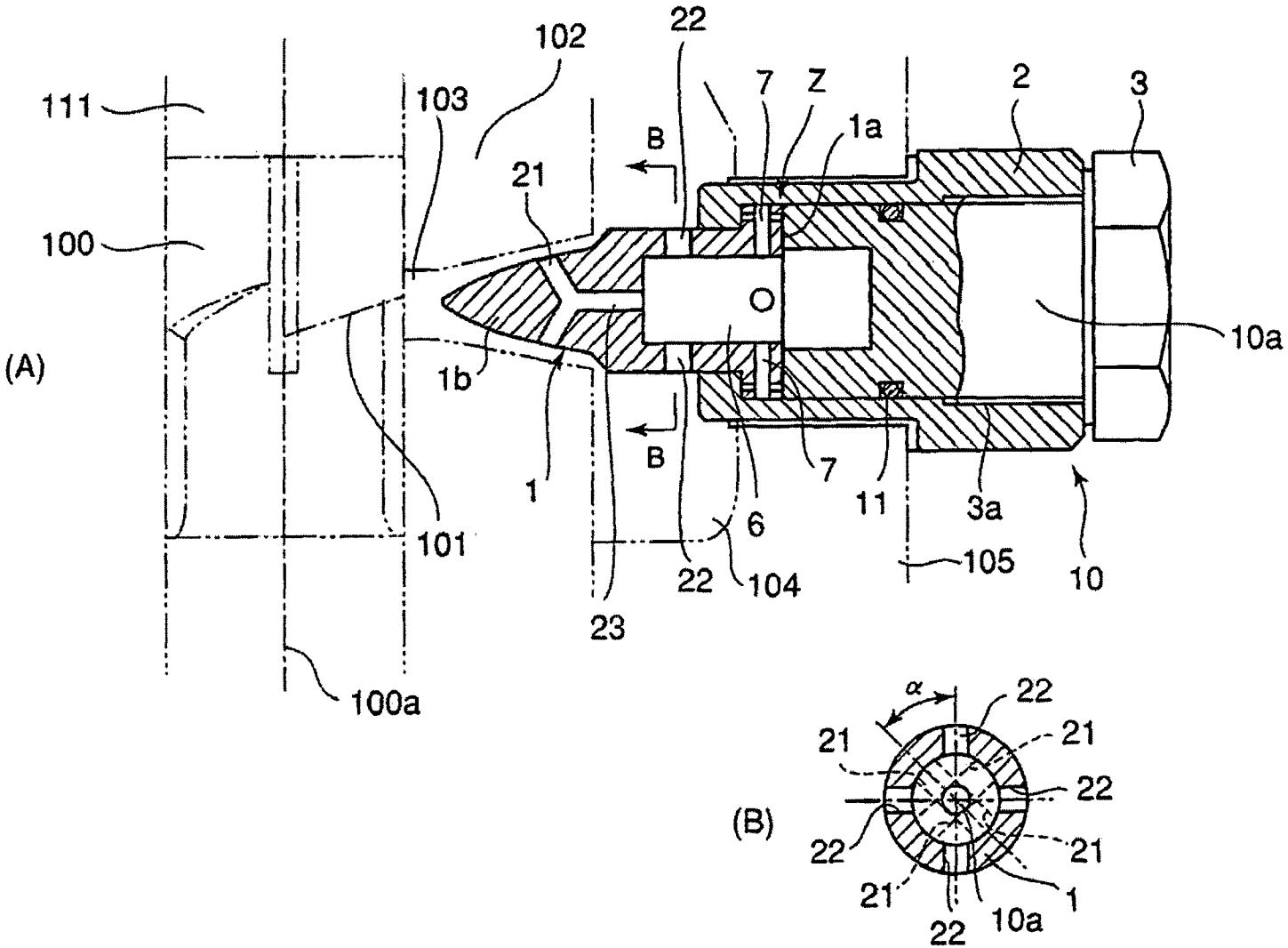
FIG. 4A is a view as in FIG. 1A of a second embodiment.
FIG. 4B is a section along line B-B in FIG. 4A.

FIG. 4A is a sectional view of the deflector in a jerk fuel injection pump of a second embodiment for a diesel engine (corresponding to part Y in FIG. 5), and FIG. 4B is a section B-B in FIG. 4A.

The second embodiment is a case the invention is applied to a so-called solid type deflector. In the drawing, the deflector 10 comprises a stationary holder which includes a case member 2 and a bolt member 3 screwed into the pump case, and a tip member 1 which is supported rotatably by the stationary members and of which an end intrudes into the inlet/spill port 103. The tip member 1 has a solid end part 1*b* intruding into the port 103. A plurality of spilled fuel inlet holes 21, a center hole 23, and a central hollow 6 are formed in the tip member 1. The spilled fuel inlet holes 21 are drilled from the outer periphery of the solid part 1*b* toward the center of the solid part of the tip member 1 to be communicated with the center hole 23. A plurality of spilled fuel outlet holes 22 are drilled radially in the cylindrical part of the tip member 1 to communicate the central hollow with the fuel gallery 104. The flange part 1*a* of the tip member is formed the same as that of the tip member of the first embodiment.

As shown in FIG. 4B, four spilled fuel inlet holes 21 and four spilled fuel outlet holes 22 are provided in this example such that they deviate by 45° from each other in circumferential direction.

The spilled fuel outlet holes 22 may be drilled tangential to the circumference of the central hollow 6. In this case, reaction force is generated by fuel flowing out through the spilled fuel outlet holes 22 to rotate the tip member 1, the tip member is positively rotated periodically every time fuel outbursts through the inlet/spill ports, so impingement of fuel against the tip member at a specific part of the tip member can be evaded more positively, that is, parts hit by the outbursting fuel are dispersed more positively.

Construction other than that mentioned above is the same as that of the first embodiment, and constituent members the same as those of the first embodiment are denoted by the same reference numerals.

With the deflector of the second embodiment, fuel that outbursts from the inlet/spill port 103 impinges on the solid end part 1*b* of the tip member 1 and then part of spilled fuel enters the spilled fuel inlet holes 21, and the tip member 1 is rotated by the impingement of fuel. Therefore, impinging portions of the fuel outbursting through the inlet/spill port 103 on the solid part 1*b* of the tip member 1 are dispersed and concentrated impingement on a specific portion of the solid part 1*b* can be evaded.

According to the invention, the deflector is divided into a stationary holder and a rotatable tip member supported rotatably by the stationary holder, fuel that outbursts through the inlet/spill port impinges against the tip member and exerts force to rotate the tip member, so concentrated impingement of the outbursting fuel on a specific portion of the tip member is evaded, resulting in that occurrence of cavitation erosion on the impinging part of the tip member due to repeated impingement of the outbursting fuel is prevented. Therefore, lifetime of the deflector is elongated and maintenance cost for replacing the deflector can be decreased.

Further, by constructing the rotary tip member such that a plurality of spilled fuel outlet holes for allowing spilled fuel entered the tip member to flow out from the tip member are drilled tangential to the circumference of the central hollow of the tip member, reaction force is generated by fuel flowing out through the tangential holes to rotate the tip member, so the tip member is positively rotated periodically every time fuel outbursts through the inlet/spill ports and part of the fuel enters the tip member, parts on the tip member hit by the outbursting fuel are dispersed more positively.

The invention claimed is:

1. A fuel injection pump comprising:

a plurality of rotary deflectors against which spilled fuel impinges, the spilled fuel being fuel that (i) outbursts from a plunger room and is injected into inlet/spill ports drilled in a plunger barrel and (ii) then flows into a fuel gallery when fuel injection ends, wherein each of said rotary deflectors comprises:

a stationary holder fixed to at least one of the plunger barrel and a pump case accommodating the plunger barrel; and a rotatable tip member rotatably supported by said stationary holder, such that said rotatable tip member rotates around a rotational axis, wherein said rotational axis, around which said rotatable tip member rotates, extends in a direction that the spilled fuel is injected into the inlet/spill ports of the plunger barrel, wherein said rotatable tip member includes a spilled fuel inlet hole (i) located in a center of said rotatable tip member, (ii) extending in a direction of said rotational axis, and (iii) opening into the inlet/spill ports of the plunger barrel and a spilled fuel outlet hole or holes of said rotatable tip member, and wherein said spilled fuel outlet hole or holes are radially located around said rotatable tip member to open into the fuel gallery and to communicate to said spilled fuel inlet hole, such that at least a portion of the spilled fuel injected into the inlet/spill ports of the plunger barrel travels through said spilled fuel inlet hole and is expelled through said spilled fuel outlet hole or holes causing said rotatable tip member to rotate around said rotational axis.

2. The fuel injection pump according to claim 1, wherein a plurality of said spilled fuel outlet holes are radially arranged, around said rotatable tip number, as spokes of a wheel.

3. The fuel injection pump according to claim 1, wherein a plurality of said spilled fuel outlet holes are tangential to a rotation direction of said rotatable tip member.

4. The fuel injection pump according to claim 1, wherein said rotatable tip member includes a flange part supported axially by said stationary holder such that small side clearances are provided between said stationary holder and said rotatable tip member, and wherein radial balance oil passages that communicate to said spilled fuel inlet hole, and axial balance holes that communicate to the radial balance oil passages are located in said flange part.

5. A fuel injection pump comprising:

a plurality of rotary deflectors against which spilled fuel impinges, the spilled fuel being fuel that (i) outbursts from a plunger room and is injected into inlet/spill ports drilled in a plunger barrel and (ii) then flows into a fuel gallery when fuel injection ends, wherein each of said rotary deflectors comprises:

a stationary holder fixed to at least one of the plunger barrel and a pump case accommodating the plunger barrel; and a rotatable tip member rotatably supported by said stationary holder, such that said rotatable tip member rotates around a rotational axis, wherein said rotational axis, around which said rotatable tip member rotates, extends in a direction that the spilled fuel is injected into the inlet/spill ports of the plunger barrel, wherein said rotatable tip members includes a solid part against which the injected spilled fuel impinges, and includes a spilled fuel inlet hole or holes extending, from an outer periphery of said solid part of said rotatable tip member that intrudes into the inlet/spill ports of the plunger barrel, into a center of said solid part of said rotatable tip member, wherein said spilled fuel inlet hole or holes communicate to a succeeding center hole located in a center portion of said rotatable tip member, and wherein said rotatable tip member includes spilled fuel outlet hole or holes radially located around said rotatable tip member to open into the fuel gallery and to communicate to said center hole, such that at least a portion of the spilled fuel injected into the inlet/spill ports of the plunger barrel travels through said spilled fuel inlet hole or holes, through said center hole, and is expelled through said spilled fuel outlet hole or holes causing said rotatable tip member to rotate around said rotational axis.

6. The fuel injection pump according to claim 5, wherein a plurality of said spilled fuel outlet holes are radially arranged, around said rotatable tip member, as spokes of a wheel.

7. The fuel injection pump according to claim 5, wherein a plurality of said spilled fuel outlet holes are tangential to a rotation direction of said rotatable tip member.

* * * * *